United States Patent [19]

Lipinski et al.

[11] Patent Number: 4,935,120

[45] Date of Patent: Jun. 19, 1990

[54] MULTI-STAGE WAX HYDROCRACKING

[75] Inventors: John J. Lipinski, Sewell, N.J.; James R. Nye, Elkton, Md.; Milos Soudek, Houston, Tex.

[73] Assignee: Coastal Eagle Point Oil Company, Houston, Tex.

[21] Appl. No.: 282,359

[22] Filed: Dec. 8, 1988

[51] Int. Cl.[5] ..... C10G 65/10

[52] U.S. Cl. ..... 208/59; 208/111

[58] Field of Search ..... 208/59, 111; 585/739

[56] References Cited

U.S. PATENT DOCUMENTS

| | | | |
|---|---|---|---|
| 3,240,694 | 3/1966 | Mason et al. | 208/111 |
| 3,254,017 | 5/1966 | Arey, Jr. et al. | 208/111 |
| 3,788,974 | 1/1974 | Buchmann et al. | 208/59 |
| 4,153,540 | 5/1979 | Gorring et al. | 208/89 |
| 4,183,801 | 1/1980 | Breuker et al. | 208/89 |
| 4,437,976 | 3/1984 | Oleck et al. | 208/97 |
| 4,446,007 | 5/1984 | Smith | 208/111 |
| 4,554,065 | 11/1985 | Penick | 208/58 |
| 4,648,957 | 3/1987 | Graziani et al. | 208/59 |
| 4,696,732 | 9/1987 | Angevine et al. | 208/111 |
| 4,720,337 | 1/1988 | Graziani et al. | 208/58 |
| 4,749,467 | 6/1988 | Chen et al. | 208/18 |

*Primary Examiner*—Anthony McFarlane

*Attorney, Agent, or Firm*—Browning, Bushman, Anderson & Brookhart

[57] ABSTRACT

A process for hydrodewaxing a petroleum or shale oil fraction, e.g., petroleum distillate, over a shape selective zeolite in the presence of hydrogen wherein the dewaxing is conducted in at least two stages, with some reheating of first effluent. Dewaxed feed, and a high octane gasoline byproduct are obtained as products.

20 Claims, 2 Drawing Sheets

MULTI-STAGE WAX HYDROCRACKING

FIELD OF THE INVENTION

The invention relates to wax hydrocracking over shape selective zeolites.

BACKGROUND OF THE INVENTION

Hydrocarbn conversion processes utilizing crystalline zeolite catalysts have been the subject of extensive investigation during recent years as is clear from both the patent and scientific literature. Crystalline aluminosilicates have been found to be particularly effective for a wide variety of hydrocarbon conversion processes and have been described and claimed in many patents including U.S. Pat. Nos. 3,140,249; 3,140,252; 3,140,251; 3,140,253; and 3,271,418. Aside from serving as general catalysts in hydrocarbon conversion processes, it is also known that the molecular sieve properties of zeolits can be utilized to preferentially convert one molecular species from a mixture of the same with other species.

In a process of this type a zeolite molecular sieve is employed having catalytic activity within its internal pore structure and pore openings such that one component of a feed is capable of entering within the internal pore structure thereof and being converted to the substantial exclusion of another component which, because of its size, is incapable of entering within the pores of the zeolitic material. Shape selective catalytic conversion is also known in the art and is disclosed and claimed in U.S. Pat. Nos. 3,140,322; 3,379,640 and 3,395,094.

Although a wide variety of zeolitic materials and particularly crystalline aluminosilicates have been successfully employed in various catalytic conversion processes, nevertheless, these prior art processes, in general, fell into one or two main categories. In one type of conversion process a zeolite was employed which had a pore size sufficiently large to admit the vast majority of components normally found in a charge, i.e., these materials are referred to as large pore size molecular sieves and they are generally stated to have a pore size of from 6 to 13 angstroms and are represented by zeolites X, Y and L. The other type of aluminosilicate was one which had a pore size of approximately 5 angstrom units and it was utilized to preferentially act upon normal paraffins to the substantial exclusion of other molecular species. Thus, by way of considerably over-simplification until recently, there were only two types of aluminosilicates which were available for hydrocarbon processing—those which would admit only normal paraffins and those which would admit all components normally present in a hydrocarbon feed charge. See U.S. Pat. No. 3,700,585 and Canadian Pat. No. 829,282.

The cracking and/or hydrocracking of petroleum stocks is in general well known and widely practiced. It is known to use various zeolites to catalyze cracking and/or hydrocracking processes.

Of particular recent interest has been the use of a novel class of catalysts to assist in the dewaxing of gas oils, lube base stocks, kerosenes and whole crudes, including syncrudes obtained from shale, tar sands and coal hydrogenation. U.S. Pat. No. 3,700,585 discloses the use of ZSM-5 zeolite to efficiently catalyze dewaxing of various petroleum feedstocks.

U.S. Pat. No. 3,700,585 discloses and claims the cracking and hydrocracking of paraffinic materials from various hydrocarbon feedstocks by contacting such feedstock with a ZSM-5 zeolite at about 290° to 712° C., 0.5 to 200 LHSV and with a hydrogen atmosphere in some cases. This patent is based upon work on the dewaxing of gas oils, particularly virgin gas oils, and crudes although its disclosure and claims are applicable to the dewaxing of any mixture of straight chain, slightly branched chain and other configuration hydrocarbons. The catalyst may have a hydrogenation/dehydrogenation component incorporated therein.

Other U.S. patents teaching dewaxing of various petroleum stocks are U.S. Pat. No. Re. 28,398; U.S. Pat. Nos. 3,852,189; 3,891,540; 3,894,933; 3,894,938; 3,894,939; 3,926,782; 3,956,102; 3,968,024; 3,980,550; 4,067,797 and 4,192,734.

Catalytic hydrodewaxing can be considered to be a relatively mild, shape selective cracking or hydrocracking process. It is shape selective because of the inherent constraints of the catalyst pore size upon the molecular configurations which are converted. It is mild because the conversions of gas oil feed to lower boiling range products is limited, e.g., usually below about 35 percent and more usually below about 25 percent. It is operative over a wide temperature range but is usually carried out at relatively low temperatures, e.g. start of run temperatures of about 270° C. are usual.

An advance in hydrodewaxing was disclosed in U.S. Pat. No. 4,446,007 (Smith), which is incorporated herein by reference. Smith recognized that the dewaxing process could be a source of high octane byproduct gasoline, provided that the temperature was raised relatively rapidly to at least 360° C. Rapid temperature increase after startup meant that there was some over dewaxing of the chargestock, but this was not harmful, and indeed even increases the blending value of the heavy fuel produced. More significantly, the byproduct gasoline was both high octane, and relatively low in aromatic content.

Smith observed that during operation, the mild drop in temperature associated with fresh hydrodewaxing catalyst rapidly diminished, and that hydrogen consumption could be reduced, and reactor delta Ts would approach zero, within about a month after startup.

Shape selective catalytic hydrodewaxing such as practiced in U.S. Pat. No. 4,446,007, to produce heavy fuel oil product is not usually considered endothermic or exothermic. Usually reactor temperatures at the outlet roughly equal the inlet temperature. Although the process is a catalytic hydrocracking process, some catalytic hydrodewaxing units create hydrogen rather consume it. They can create $H_2$ because a long chain paraffin in cracked into two or more olefinic fragments. This makes $H_2$. The olefins may or may not be saturated before they leave the hydrocracking reaction zone, and this saturation consumes hydrogen.

To summarize, shape selective catalytic hydrodewaxing to produce fuels is an unusual hydrocracking process in that there is not much temperature change through the reactor, there is not much hydrogen consumption, and it is usually conducted in a single stage. "Single stage" means that dewaxing is customarily conducted in one large reactor, or in several reactors in series, with no intermediate heating, cooling, removal of impurities, etc. between reactor beds. This is in contrast to conventional hydrocracking processes, which usually operate in several stages, with one or more quench stages to prevent temperature runaway.

We realized that catalytic dewaxing unit as proposed in U.S. Pat. No. 4,446,007 (Smith), would give an optimum startup, but not necessarily an optimum operation thereafter. The rapid start-up procedure of Smith solved the problem of making the dewaxing unit an efficient generator of high octane gasoline during startup, but did not solve the problem of working the catalyst to the maximum extent possible or extending the run length. We discovered a way to make the dewaxing unit produce even more high octane gasoline, and/or last for a longer period of time, than had heretofore been thought possible.

BRIEF SUMMARY OF THE INVENTION

Accordingly the present invention provides a process for catalytic hydrodewaxing of a wax containing feed in a reactor by contacting said feed with hydrogen in the presence of a catalyst comprising a shape selective crystalline zeolite having a silica to alumina mole ratio of at least 12 at a reactor inlet temperature above 300° C., a liquid hourly spaced velocity of about 0.2 to 10, a reactor pressure of about 100 psig to 3000 psig and a hydrogen to hydrocarbon mole ratio greater than zero to about 20, the improvement which comprises conducting the process in at least two stages, with an inlet temperature to the first stage in excess of 360° C. to produce a first stage partially dewaxed effluent at a reduced temperature relative to said first stage inlet temperature, heating the effluent from the first stage by at least 5° C., and charging the heated first stage effluent to the second stage to produce a dewaxed hydrocarbon product.

In another embodiment the present invention provides a process for the selective cracking of wax in a heavy feed in a hydrogen containing atmosphere over a shape selective zeolite wax cracking catalyst at a temperature in excess of about 360° C. to produce a dewaxed heavy feed and a gasoline boiling range product having a research clear octane number of at least 90, the improvement comprising hydrocracking the wax in at least a first stage reaction zone and at least a second stage reaction zone, and the first produces a first stage effluent which is heated and charged to the second stage reaction zone.

In a more limited embodiment, the present invention provides in a process for catalytic hydrodewaxing of a wax containing feed in a reactor by contacting said feed with hydrogen in the presence of a catalyst comprising a shape selective crystalline zeolite having a silica to alumina mole ratio of at least 12 at a reactor inlet temperature above 300° C., a liquid hourly space velocity of 0.2 to 10, a reactor pressure of 100 psig to 3000 psig at least 1500 SCFB of hydrogen, the improvement comprising conducting the wax hydrocracking in at least a first and at least a second stage reaction zone, and wherein endothermic wax cracking reactions predominate in the first stage reacton zone which endothermic reactions cause a reduction in temperature across the first stage reaction zone of at least 10° C. and wherein the temperature in the second stage zone is increased by the addition of 400–1500 SCFB $H_2$ of hot hydrogen to the first zone effluent thereby increasing the temperature in said second stage reaction relative to the temperature of the first stage effluent.

DETAILED DESCRIPTION

Figure 1:
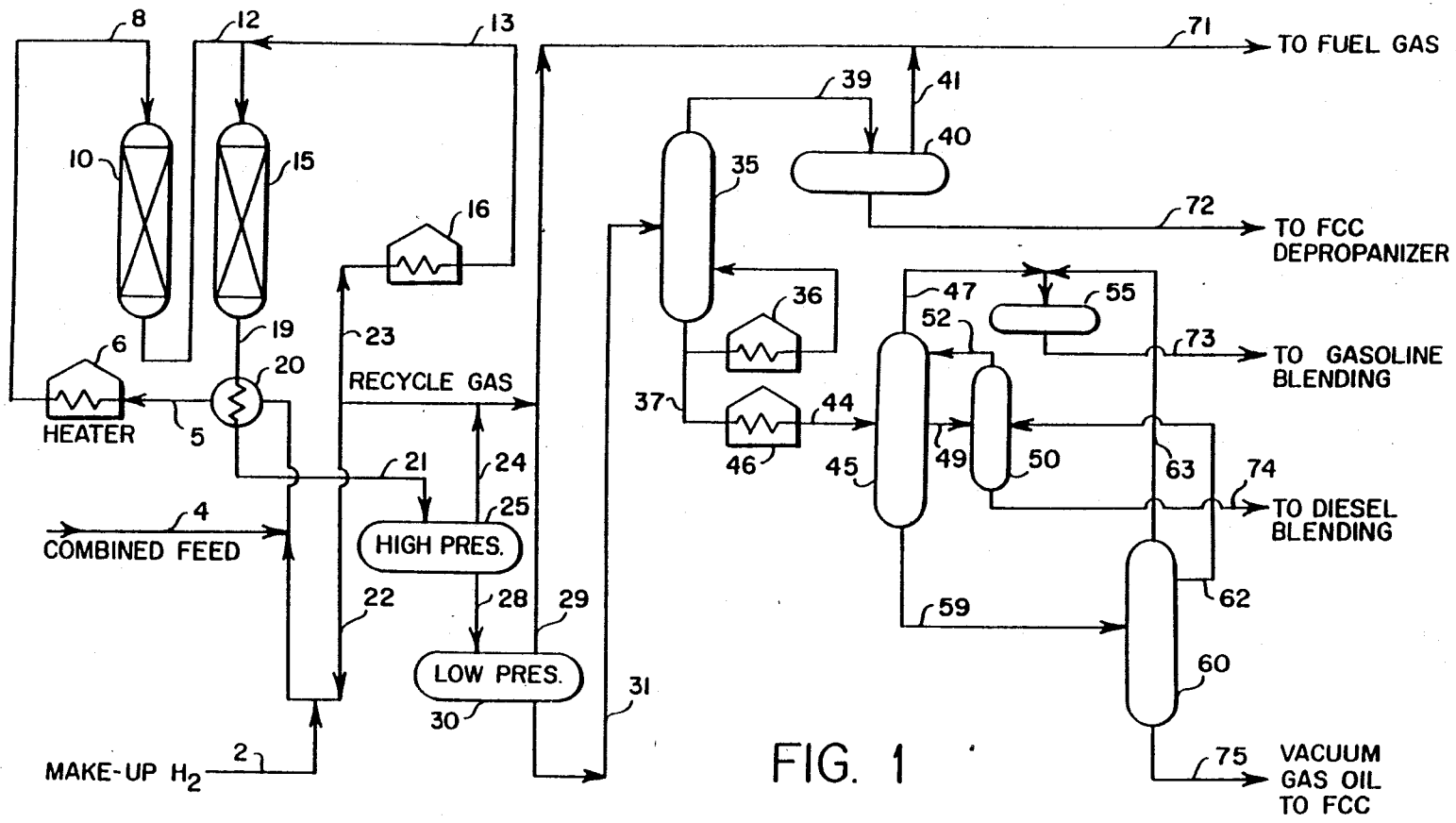
FIG. 1 is a simplified, schematic view of a dewaxing unit of the present invention.

The process of out invention involves may aspects which are conventional (such as feedstock, dewaxing catalyst, etc.) and some aspects which are new to shape selective catalytic dewaxing (multistage operation, with heat added intermediate the stages). The conventional aspects will be briefly discussed, followed by a more detailed discussion of the multistage, reheating aspects of our invention.

FEEDSTOCKS

Any waxy material which has heretofore been processed in shape selective catalytic dewaxing processes can be used. This includes gas oils, lube stocks, kerosenes, whole crudes, synthetic crudes, tar sand oils, shale oils, etc. These heavy feeds may be subjected to one or more conventional pretreatment steps, such as hydrotreating, to remove excessive amounts of nitrogen impurities, metals, etc.

The preferred chargestocks are gas oils and vacuum gas oils derived from paraffinic crudes. Gas oils contemplated for use herein will have boiling ranges of 350°–850° F., while vacuum gas oils typically have boiling ranges of 500°–900° F.

Pour points are typically 75°–100° F., or more, frequently, 85°–90° F., with cloud points perhaps 5° F. above the pour point.

The feed preferably is slightly heavier, re end point, than the specification end point of the desired product. This is somewhat heavier than the conventional feed (usually an atmospheric gas oil) to shape selective catalytic dewaxing units making fuel oil products. Some light vacuum gas oil, or material boiling in this range, is preferably present in the feed.

The dewaxing process can convert some feeds boiling beyond the diesel or No. 2 fuel oil boiling range into materials boiling within the desired range. The dewaxing process used herein is not an efficient converter of heavy feeds to lighter feeds, and will leave some fractions of the feed (primarily the aromatic and naphthenic fractions) relatively untouched, so although these nonparaffinic materials can be tolerated in the feed, they are not efficiently converted by the shape selective zeolite catalyst. A relatively heavy feed, with product end point specs satisfied by downstream fractionation, maximizes production of more valuable light products from less valuable heavy feed.

CATALYST

Any conventional shape selective zeolite which can be used to selectively crack normal paraffins in a heavy hydrocarbon stream can be used herein. More details on suitable zeolites, and their properties are disclosed in U.S. Pat. No. 4,446,007.

As disclosed in U.S. Pat. No. 4,446,007, the preferred zeolites have a Constraint Index of 1–12.

Of the zeolite materials useful in the present process, zeolites ZSM-5, ZSM-11, ZSM-12, ZSM-23, ZSM-35, ZSM-38 and ZSM-48 are noted. Zeolite ZSM-5 is preferred. ZSM-5 is described in U.S. Pat. No. No. 3,702,886 and U.S. Pat. No. Re 29,948, each being incorporated by reference. ZSM-11 is described in U.S. Pat. No. 3,709,979, which is incorporated by reference. ZSM-12 is described in U.S. Pat. No. 3,832,449, which is incorporated by reference. ZSM-23 is described in U.S. Pat. No. 4,076,842, which is incorporated herein by reference. U.S. Pat. Nos. 4,016,245 and 4,046,859, describing ZSM-35 and ZSM-38, respectively, are incorporated herein by reference.

CATALYTIC DEWAXING CONDITIONS

The conditions in each stage of the catalytic dewaxing reaction zone are broadly within those conditions heretofore found suitable for shape selective catalytic hydrodewaxing. More details of preferred conditions are recited in U.S. Pat. No. 4,446,007 (Smith).

Briefly, the shape selective catalytic dewaxing occurs at temperature from 316°–454° C. (600°–850° F.), at LHSVs ranging from 0.1–10. Preferred conditions include temperature of at least 360° C.

Pressures are usually mild, typically on the order of prior art hydrotreating processes ranging around 100–1000 psig. Operation with 400 pounds of hydrogen partial pressure gives good results.

OVERALL DEWAXING SEVERITY

In the process of our invention, higher conversions of feed to lighter products are obtained, relative to what was the norm for prior art shape selective catalytic hydrodewaxing processes. Operation at high temperatures suggested in U.S. Pat. No. 4,446,007 (Smith) converts catalytic dewaxing (CDW) from a process which merely dewaxes and produces some low octane gasoline boiling range byproduct, to a process which not only dewaxes but also efficiently generates high octane gasoline which can be added directly to the refinery blending pool. Even more desirably, the high octane gasoline by-product produced by catalytic dewaxing is relatively low in aromatics.

Accordingly, we prefer to operate with somewhat higher temperatures, and conversions than was heretofore considered the norm. Conversions of at least 15 wt. % of the feed to products boiling in the gasoline and lighter range should be achieved, and most preferably conversions of 20–45% of the feed to lighter products should be achieved. Depending on paraffin content of the chargestock, conversions of 30–50 wt. % of the feed, or more, to lighter products are contemplated herein. Gasoline yields of 20–25 wt. % of the feed may be achieved.

Expressed as wt. % conversions of waxy paraffins in the feed, it is preferred to crack most of the paraffins, more preferably, 75 wt. % of the normal and slightly branched paraffins, with 90+% conversions being possible in some cases.

Expressed as gasoline octane, the overall severity should be enough to produce a gasolie boiling range fraction having an octane number (Research Clear) of 90 or higher, preferably above 91, and most preferably above 92.

The average reactor temperature (weight average bed temperature) will be somewhat higher in our process as compared to the prior art, although the average inlet temperature to the first reactor will not change so much. This is because the primary effect of out invention is higher temperatures in the second stage, rather than higher temperatures in the first stage.

MULTISTAGE-SEVERITY CONTROL

Our invention requires that the dewaxing process be operated in at least two stages, with some control of severity in each stage. We can shift $H_2$ addition or adjust severity, or preferably, do both. We will first review one stage operation (prior art, U.S. Pat. No. 4,446,007), then address our two stage process.

Some prior art catalytic dewaxing processes, when operated as efficient generators of high octane gasoline, had a significant endothermic reaction in the first 25% or so of the catalyst bed, which was largely offset by exothermic reactions occurring in the latter portions of the bed. After the unit lined out (within 30 days) an observer looking at the process would see little or no temperature change between feed and products. Very little hyrogen consumption was shown in, FIG. 3 of U.S. Pat. No. 4,446,007 (Smith). A casual observer who was familiar with shape selective catalytic dewaxing would not expect any significant temperature change, because although the cracking of wax is endothermic, the hydrogenation of the resulting olefinic fragments would be an offsetting, exothermic reaction.

We then observed the operation of a commercial dewaxing unit which happened to be conducted in two reactors. Although the reaction was conducted in two separate reactor vessels, they functioned as a single stage because there was no intermediate heating or cooling, nor addition or removal of anything in between reactor 1 and reactor 2. Two reactors held the catalyst, but it was a one stage process. By analyzing the temperature of the feed, and the reactor 1 and 2 outlets we realized that there was a significant drop in temperature in the first reactor, and temperature would increase slightly, if at all, in the second reactor. Sometimes there would be a slight further decrease in temperature (3° to 7° F.) in the second reactor as well.

We wanted to have a measure of control over the reaction severity in reactor 1 and 2. Our belief was that the existing process was not being operated as efficiently as possible, because the catalyst temperature was reduced excessively through much of the second reactor, and probably in some of the first reactor too.

We realized that by adding more hydrogen to the reactor 1 effluent, and adding the $H_2$ hot, it would be possible to heat the material going to the second reactor and make the second reactor work harder.

Based on our commercial operating experience, we realized that the inlet temperature of the second stage should be increased preferably by at least 5° F. and, if possible, increased to within 15° C. of the reactor 1 inlet, and preferably within 10° C., and most preferably have a temperature approaching that of the first reactor inlet.

It would be possible to conduct the process in 3, 4, or even more reactors, but in most instances the benefits to be gained by such an elaborate reactor design will not be offset by the cost associated with the elaborate design.

When a two reactor system is used, the first reactor should contain 25–70% of the total inventory of shape selective zeolite catalysts, while the second reactor should contain 30–75%.

Based on our experimental work with one commercial unit (with about a $\frac{1}{3}$–$\frac{2}{3}$ split between catalyst in the first and second reactors) we believe that in future installations the optimum catalyst loading will be about the same.

For a three reactor system, the first reactor could contain 10–40% of the total catalyst inventory while the second reactor could contain 20–40%, with the remainder being in the third reactor.

Heat can be added in many ways to the second reactor. The easiest method for a retrofit is addition of a hot hydrogen stream. Any other conventional means of getting heat into the second stage can be used, e.g., indirect heat exchange, addition of some hot material which is not harmful to the process, or passing the first reactor effluent through a fired heater.

DETAILED DESCRIPTION OF FIG. 1

Figure 2:
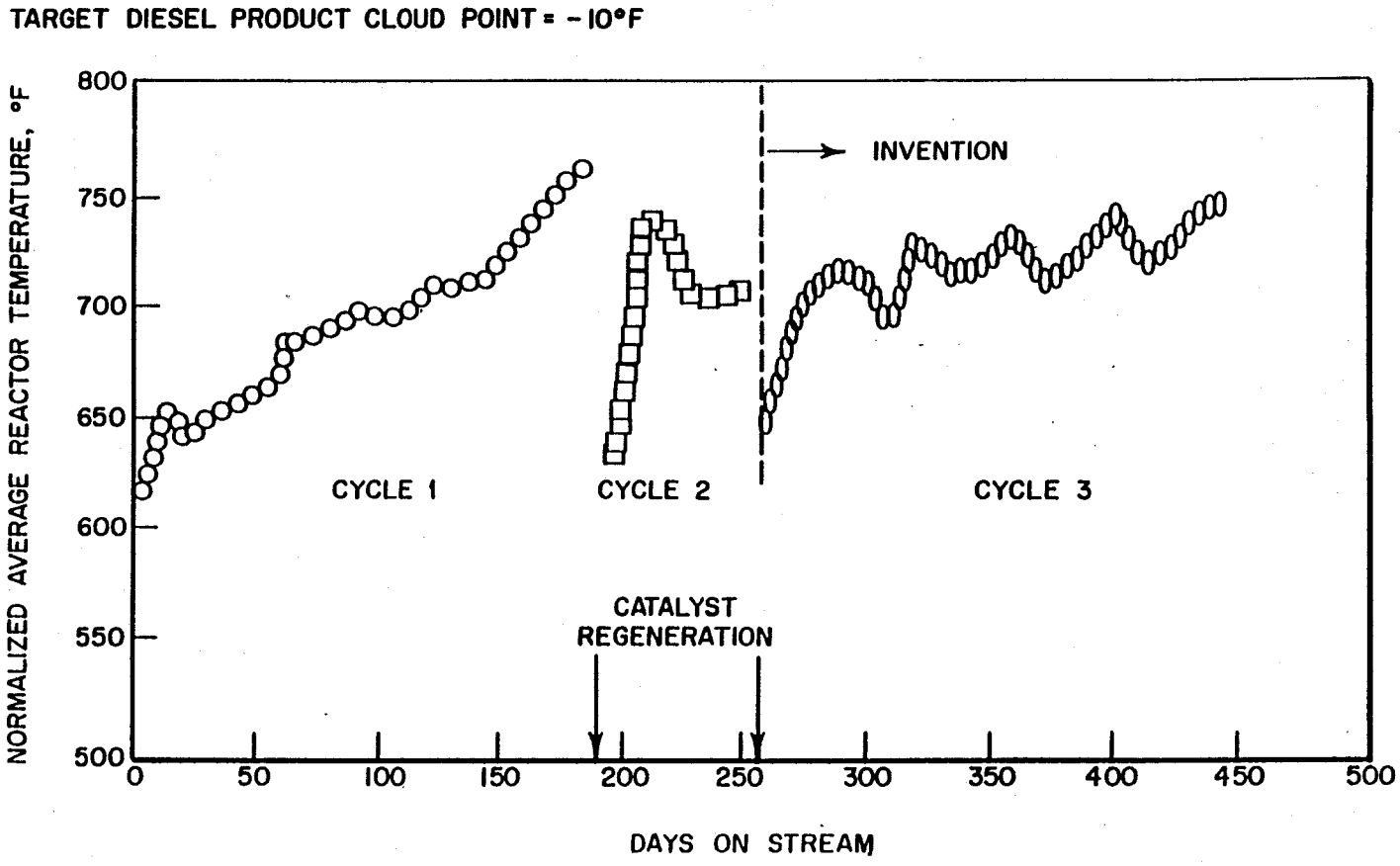
FIG. 2 shows days on stream v. temperature of a commercial dewaxig reactor.

The present invention can be better understood with reference to the attached figures. FIG. 1 shows a considerably simplified process flow diagram of one embodiment of the invention, while FIG. 2 shows average reactor temperatures versus days on stream during several commercial tests of a dewaxing unit.

In FIG. 1, a combined heavy feed, comprising a Heavy Atmospheric Gas Oil (HAGO), Light Vacuum Gas Oil (LVGO) and FCC Intermediate Cycle Oil (ICO) are added via line 4, mixed with makeup $H_2$ rich gas in line 2, recycle $H_2$ rich gas in line 22 and passed through heat exchanger 20 and line 5 into heater 6. The heated feed is charged via line 8 into the first stage reactor 10. The first stage effluent is removed via line 12. The first reactor effluent, within a month after startup, usually is at least 10° C. cooler than the feed in line 8. There is a drop in temperature because of the endothermic wax cracking reactions occurring in first stage reactor 10. First stage effluent is heated, by adding hot hydrogen from line 13. The resulting mixture is passed into second stage reactor 15. The dewaxed heavy feed, cracked products and $H_2$ are removed via line 19, passed through heat exchanger 20 and discharged via line 21 into high pressure separator 25.

Actually, the figure is quite a simplification of the actual refinery operation. All of the feed, and much of the recycle and make-up $H_2$ was charged to a heater and then passed to reactor 1. The heater 6 could not handle the load, so we used a separate heater 16, which happened to be available. This second heater was used to heat a portion of the recycle and make-up $H_2$. The material from both heaters entered the first reactor 10. The first reactor functioned just as it would have with a conventional single heater for the combined stream of oil and recycle and make-up gas. Our unusual heater system (with two heaters instead of the more normal single heater) was then further modified, by the addition of a line equivalent to line 13 shown in FIG. 1, to allow us to add hot $H_2$ directly to the reactor 1 effluent, and thereby heat the feed to the second reactor.

Our actual point of make-up $H_2$ addition was also somewhat different than that shown in FIG. 1, but the difference is not important to the process. The make-up $H_2$ purity from a Pt reformer varies from day to day because of normal fluctuations of the reformer. The shape selective catalytic dewaxing unit usually cleans up the hydrogen which is a little unusual for a hydrogen consuming unit. Thus there is very little difference in hydrogen purity of the make-up $H_2$ to the dewaxing unit and the $H_2$ purity of the dewaxing unit recycle gas, so the point of addition of make-up $H_2$ is not critical. In our plant, the make-up $H_2$ was added to the recycle $H_2$. Some of the combined $H_2$ stream (recycle+make-up $H_2$) was mixed with the oil feed, and the remainder of the combined $H_2$ was sent to the second heater 16, i.e., to the heater with no oil feed.

High pressure separator 25 operates at a temperature of 60°–130° F. and pressure of about 525 psig. A hydrogen rich gas stream is withdrawn via line 24 and removed as a fuel gas by-product in line 71, recycled to mix with fresh feed via line 22 or sent via line 23 to heater 16 to produce the hot hydrogen rich gas in line 13.

Liquid is removed from high pressure separator 25 via line 28 and discharged into low pressure separator 30, operating at a temperature of 60°–130° F. and a pressure of 175–180 psig. A fuel gas stream is removed via line 29. Flashed liquid is removed via line 31 and charged to stabilizer or debutanizer 35. $C_4$ and lighter hydrocarbons are removed overhead via line 39, cooled in cooling means not shown, and charged to overhead accumulator 40. The figure is also somewhat simplified re this and other distiallation columns, i.e., reflux lines, coolers associated with column overhead vapor lines, pumps, etc. have been omitted for clarity. A fuel gas stream is removed via line 41 while a $C_3/C_4$ rich liquid is discharged via line 72, for further processing in the FCC depropanizer.

Stabilizer 35 is reboiled using conventional reboiler 36. The net bottoms products is removed via line 37, passed through heater 46 and discharged via line 44 into splitter column 45. Gasoline boiling range hydrocarbons are removed overhead via line 47 and discharged into overhead accumulator 55. Gasoline boiling range hydrocarbons are removed via line 73 as a product.

An intermediate boiling range stream is removed from column 45 via line 49 and charged to steam side stripper 50. Light materials are discharged overhead via line 52 and sent back to the main column 45, while a diesel fraction is removed via line 74 as a product.

A bottoms product is withdrawn via line 59 from column 45 and charged to vacuum flash 60. An overhead vapor stream is removed via line 63 and charged to overhead accumulator 55 for recovery of gasoline boiling range components. An intermediate boiling range stream is withdrawn via line 62 and charged to steam side stripper 50, while a vacuum gas oil fraction is withdrawn via line 75.

EXAMPLE

The invention was tested in a commercial dewaxing unit. As is common in all operating commercial units, the unit was being run to make a product, not to generate data. There are always changes in operation, and problems so there is quite a scatter in the data generated by a commercial plant. The commercial test occurred at a refinery which runs heavy paraffinic crudes, with attendant distillate fluidity problems.

The refinery chose shape selective catalytic dewaxing as the most cost effective way of eliminating distillate cold flow problems and improving plant profitability. The refinery had an idle high pressure hydrotreating unit which was built in 1972 to pretreat 17,000 BPSD of heavy FCC naphtha prior to reforming. For a number of reasons, the unit was mothballed. Thus unit contained most of the equipment required by the CDW process except for the addition of one major vessel. Changes were made to the piping and reactor internals and the unit pressure was dropped to 525 psig. FIG. 1 is a schematic of the revamped unit.

A typical feedstock is reported below.

TABLE 1

| TYPICAL CDW FEEDSTOCK | |
|---|---|
| API Gravity | 29.4 |
| Pour Point, °F. | 85 |
| Aniline Point, °F. | 180 |
| K Factor | 11.8 |
| Distillation, °F. (D-1160) | |
| 10% | 631 |
| 30% | 672 |
| 50% | 699 |

TABLE 1-continued

| TYPICAL CDW FEEDSTOCK | |
|---|---|
| 70% | 733 |
| 90% | 800 |

Although the operation of the CDW reactor section is similar to a hydrodesulfurizer (HDS), that is, oil and hydrogen are passed over a fixed bed of catalyst, the disposition of the products and by-products is different. The unsaturated light liquid hydrocarbons from the stabilizer are sent to the FCC gas plant for further recovery. The butenes become alkylation feed. Propenes are polymerized. The CDW naphtha is sent directly to gasoline blending. The distillate product is blended directly to diesel fuel, and the bottoms are recycled to the FCC unit.

Direct blending of CDW naphtha into the gasoline pool is possible because of its high octane number (typically 92 RONC) and low mercaptan level. Table 2 lists the properties of this stream. Caustic and water washing equipment were added to the unit to handle high mercaptan levels, but the low sulfur crudes run to date have made it unnecessary to use the facilities. If high sulfur crudes are processed, this equipment will have to be activated.

TABLE 2

| TYPICAL CDW GASOLINE PRODUCT PROPERTIES[1] | |
|---|---|
| Properties | |
| API Gravity | 70 |
| Sulfur, wt. % | 0.01 |
| Mercaptans, ppmw | 35 |
| Bromine Number | 140 |
| Octanes | |
| RON-Clear | 92 |
| MON-Clear | 79 |
| Composition,[2] Vol. % | |
| Paraffins | 32 |
| Olefins | 60 |
| Naphthenes | 5 |
| Aromatics | 3 |
| Distillation, °F. (D-86) | |
| IBP | 95 |
| 5 Vol % | 115 |
| 10 Vol % | 130 |
| 30 Vol % | 155 |
| 50 Vol % | 180 |
| 70 Vol % | 220 |
| 90 Vol % | 275 |
| 95 Vol % | 300 |
| EP | 325 |

[1]Derived from waxy crudes
[2]Debutanized sample

The CDW diesel oil is a blend of slide draws from the splitter and the vacuum flash unit. The target pour point is typically minus 10° F., but it is adjusted to meet pool fluidity requirements. The low pour point CDW product is blended with FCC light cycle oil and virgin distillates to meet No. 2 and diesel fuel specifications. Properties of these three blending stocks are shown on Table 3.

TABLE 3

| PROPERTIES OF DIESEL BLENDING COMPONENTS[1] | | | |
|---|---|---|---|
| | CDW Distillate | LAGO | FCC LOO |
| Properties | | | |
| API Gravity | 28.0 | 35.7 | 28.7 |
| Sulfur, wt % | 0.12 | 0.08 | 0.10 |
| Nitrogen, ppmw | 250 | 68 | 140 |

TABLE 3-continued

| PROPERTIES OF DIESEL BLENDING COMPONENTS[1] | | | |
|---|---|---|---|
| | CDW Distillate | LAGO | FCC LOO |
| Basic Nitrogen, ppmw | 102 | 47 | 72 |
| Kinematic Vis. @ 40° C., cs | 6.92 | 3.16 | 2.79 |
| Kinematic Vis. @ 100° C., cs | 2.04 | 1.26 | 1.13 |
| Flash Point (COC), °F. | 150 | 194 | 150 |
| Carbon Residue, wt % | 0.01 | 0.03 | 0.01 |
| Aniline Point, °F. | 150 | 156 | 125 |
| Bromine Number | 9.0 | 0.9 | 12 |
| Cetane Index | 48 | 54 | 40 |
| Fluidity | | | |
| Pour Point, °F. | −10 | 10 | 10 |
| Cloud Point, °F. | 0 | 14 | 18 |
| Distillation, °F. (D-86) | | | |
| IBP | 348 | 359 | 396 |
| 5 Vol % Distilled | 435 | 425 | 410 |
| 10 Vol % Distilled | 479 | 449 | 472 |
| 30 Vol % Distilled | 587 | 503 | 472 |
| 50 Vol % Distilled | 618 | 535 | 512 |
| 70 Vol % Distilled | 641 | 564 | 558 |
| 90 Vol % Distilled | 671 | 602 | 614 |
| 95 Vol % Distilled | 685 | 625 | 635 |
| EP | 701 | 650 | 659 |

[1]Derived from waxy crudes

CDW Catalyst Aging

As shown in FIG. 2, the catalyst has an initial high aging rate, but then it lines out to provide a long cycle. The temperature variations on FIG. 2 are due to the many shifts in crude quality that the refinery experiences. Variations due to throughput (space velocity) and product pour point have been accounted for by normalizing the data to a pour point of minus 10° F. and a design throughput of 17,000 BPDS. FCC variations as well as crude shifts have not been accounted for in normalizing the data.

When the CDW unit was streamed some downstream fractionation equipment was not ready for operation. These were commissioned later in the first cycle. The run length for this cycle exceeded six months. The second cycle was cut short due to a scheduled crude unit turn around.

A hot hydrogen reheat line was added before the start of the third cycle. There was also an improvement in virgin feed quality, because of the crude unit modifications. With hot hydrogen reheat, and better feed, the third cycle length was increased to 264 days on stream.

FIG. 2 thus shows the reduced catalyst aging rates achieved through the process of the present invention. Cycle 1 and cycle 2 represent prior art dewaxing processes, i.e., with no reheating of the first stage effluent from reactor 10. Cycle 3 represents the present invention, namely adding about 1100–1200 SCFB of hot, $H_2$ rich gas to increase the inlet temperature about 7° to 35° F., depending on charge rate, to the second stage dewaxing reactor 15.

Although the data show quite a lot of scatter, as is to be expected in commercial units, the data nonethless show the much longer cycle lengths (reduced catalyst aging rates) can be achieved by conducting the dewaxing process in at least two stages, with hot hydrogen addition to the second stage.

We claim:

1. In a process for catalytic hydrodewaxing of a wax containing feed in a reactor by contacting said feed with hydrogen in the presenece of a catalyst comprising a shape selective crystalline zeolite having a silica to alumina mole ratio of at least 12 at a reactor inlet temperature above 300° C., a liquid hourly space velocity of about 0.2 to 10, a reactor pressure of about 100 psig to 3000 psig and a hydrogen to hydrocarbon mole ratio greater than zero to about 20, the improvement which comprises conducting the process in at least two stages, with an inlet temperature to the first stage in excess of 360° C. to produce a first stage partially dewaxed effluent at a reduced temperature relative to said first stage inlet temperature, heating the effluent from the first stage by at least 3° C., and charging the heated first stage effluent to the second stage to produce a dewaxed hydrocarbon product.

2. The process of claim 1 wherein the first stage effluent is heated by adding a hot hydrogen containing gas stream thereto.

3. The process of claim 1 wherein endothermic reactions in the first stage cause a drop in temperature of at least 10° C., and the first stage effluent is reheated by at least 5° C.

4. The process of claim 1 wherein the first stage effluent is reheated to a temperature within 10° C. of the first stage inlet temperature.

5. The process of claim 1 wherein the feed comprises paraffinic gas oil and vacuum gas oil boiling range hydrocarbons and has a pour point above 75° F.

6. The process of claim 1 wherein the feed comprises paraffinic gas oil and vacuum gas oil boiling range hydrocarbons and has a pour point above 85° F.

7. The process of claim 1 wherein the zeolites is selected from the group consisting of ZSM-5, ZSM-11, ZSM-12, ZSM-23, ZSM-35, ZSM-38 and ZSM-48.

8. The process of claim 1 wherein the catalyst comprises ZSM-5.

9. The process of claim 1 wherein at least 20 wt. % of the feed is cracked to a gasoline boiling range product having a research clear octane number of at least 92.

10. In a process for the selective cracking of wax in a heavy feed in a hydrogen containing atmosphere over a shape selective zeolite wax cracking catalyst at a temperature in excess of about 360° C. to produce a dewaxed heavy feed and a gasoline boiling range product having a research clear octane number of at least 90, the improvement comprising hydrocracking the wax in at least a first stage reaction zone and at least a second stage reaction zone, wherein the first stage produces a first stage effluent which at a lower temperature compared to the temperature of the heavy feed which is fed to the first stage, and wherein said first stage effluent is heated and charged to the second stage reaction zone.

11. The process of claim 10 wherein heat is added by adding a hot, hydrogen-containing gas stream.

12. The process of claim 10 wherein heat is added by indirect heat exchange of first stage effluent with a source of heat.

13. The process of claim 10 wherein heat is added by passing the first stage effluent through a fired heater.

14. The process of claim 10 wherein the process converts at least 20 to 45 wt. % of the feed to lighter boiling components including gasoline boiling range hydrocarbons and wherein the gasoline boiling range product has a research clear octane number of at least 92.

15. The process of claim 10 wherein there is an endothermic wax cracking reaction in the first stage which reduces the temperature by at least 10° C., sufficient heat is added to the first stage effluent to increase the temperature at least 5° C., at least 20 vol. % gasoline boiling range product is recovered and the gasoline product has a research clear octane number of at least 90.

16. The process of claim 15 wherein the octane number is at least 92.

17. The method of claim 10 wherein the zeolite is selected from the group consisting of ZSM-5, ZSM-11, ZSM-12, ZSM-23, ZSM-35, ZSM-38 and ZSM-48.

18. The method of claim 15 wherein the zeolite is ZSM-5.

19. In a process for catalytic hydrodewaxing of a wax containing feed in a reactor by contacting said feed with hydrogen in the presence of a catalyst comprising a shape selective crystalline zeolite having a silica to alumina mole ratio of at least 12 at a reactor inlet temperature above 360° C., a liquid hourly space velocity of 0.2 to 10, a reactor pressure of 100 psig to 3000 psig and with at least 1500 standard cubic feet per barrel (SCEB) of hydrogen, the improvement comprising conducting the wax hydrocracking in at least a first and at least a second stage reaction zone, and wherein endothermic wax cracking reactions predominate in the first stage reaction zone which endothermic reactions cause a reduction in temperature across the first stage reaction zone of at least 10° C. and wherein the temperature in the second stage zone is increased by the addition of 400–1500 SCFB $H_2$ of hot hydrogen to the first zone effluent thereby increasing the temperature in said second stage reaction zone relative to the temperature of the first stage effluent.

20. The method of claim 19 wherein said crystalline zeolite is selected from the group consisting of ZSM-5, ZSM-11, ZSM-12, ZSM-23, ZSM-35, ZSM-38 and ZSM-48.

* * * * *